US006460310B1

(12) United States Patent
Ford et al.

(10) Patent No.: US 6,460,310 B1
(45) Date of Patent: Oct. 8, 2002

(54) COMPOSITE I-BEAM HAVING IMPROVED PROPERTIES

(75) Inventors: Brian McNeil Ford, Grayslake, IL (US); Daniel Witold Krassowski, Columbia Station, OH (US)

(73) Assignee: Graftech Inc., Lakewood, OH (US)

( * ) Notice: Subject to any disclaimer, the term of this patent is extended or adjusted under 35 U.S.C. 154(b) by 0 days.

(21) Appl. No.: 09/670,088

(22) Filed: Sep. 26, 2000

(51) Int. Cl.[7] ..... E04C 3/30

(52) U.S. Cl. ..... 52/729.1; 52/729.2; 52/729.4; 52/730.7

(58) Field of Search ..... 52/730.1, 729.1, 52/729.2, 729.4, 730.7

(56) References Cited

U.S. PATENT DOCUMENTS

| | | | | |
|---|---|---|---|---|
| 3,404,061 A | | 10/1968 | Shane et al. | 161/125 |
| 3,413,188 A | * | 11/1968 | Allen | |
| 4,893,961 A | | 1/1990 | O'Sullivan et al. | 403/232.1 |
| 4,895,713 A | | 1/1990 | Greinke et al. | 423/448 |
| 5,026,593 A | * | 6/1991 | O'Brien | |
| 5,443,894 A | * | 8/1995 | Pollock et al. | |
| 5,968,669 A | | 10/1999 | Liu | 428/537 |
| 5,974,760 A | * | 11/1999 | Tingley | |
| 6,012,262 A | | 1/2000 | Irving | 52/729.4 |
| 6,050,047 A | | 4/2000 | Covelli et al. | 52/730.7 |
| 6,173,550 B1 | * | 1/2001 | Tingley | |

FOREIGN PATENT DOCUMENTS

| | | |
|---|---|---|
| GB | 961344 | 6/1964 |
| GB | 1088855 | 10/1967 |

* cited by examiner

*Primary Examiner*—Blair M. Johnson
(74) *Attorney, Agent, or Firm*—James R. Cartiglia

(57) ABSTRACT

A composite I-beam is presented. The inventive I-beam includes a first flange and a second flange, with a web extending between the first and second flanges. At least one of the flanges of the inventive I-beam has a reinforcing layer of a supporting material thereon or therein.

6 Claims, 3 Drawing Sheets

COMPOSITE I-BEAM HAVING IMPROVED PROPERTIES

TECHNICAL FIELD

The present invention relates to an I-beam made from engineered lumber, and having improved properties. More particularly, the present invention relates to a composite I-beam formed from a pair of parallel flanges with a web of oriented strandboard extending therebetween. At least one of the flanges is reinforced, thereby providing more desirable failure characteristics.

BACKGROUND OF THE INVENTION

In residential and commercial construction, conventional solid sawn lumber joists used for floor supports (such as 2"×12" lumber joists), usually made from spruce, fir or pine, are often being replaced by I-beams. An I-beam is a structural member having upper and lower flanges corresponding to the top and bottom horizontal portions of the "I" and what is referred to as a web therebetween. Of course, the strength of the I-beam depends on the materials of construction, where, for instance, a steel I-beam is structurally stronger (albeit much heavier) than a wood I-beam, as well as the dimensions of the component parts, where, for instance, an I-beam having a tall web is generally stronger than an I-beam with a short web (assuming the same thickness of web and size of the flanges). That said, wood I-beams can be stronger and lighter, as well as less expensive, than similar sizes of solid sawn lumber.

Although steel I-beams may be most desirable in terms of strength, the weight and cost of steel I-beams make them prohibitive. Although wood I-beams are far more desirable than steel I-beams in terms of weight and cost, for applications such as residential construction, the behavior of the wood I-beam in case of fire is an important consideration. More specifically, regardless of the strength and other characteristics of a wood I-beam, without having fire endurance and related properties equivalent to or better than solid sawn lumber joists, wood I-beam are of limited practicality in most applications. Included in the desirable characteristics is time-to-failure and failure mode (i.e., whether the failure is catastrophic, or sudden, or whether there is bowing/deflection and other effects usually observed with solid sawn lumber) of solid sawn lumber in a fire.

As noted, a wood I-beam, also often referred to as a composite I-beam, typically has two flanges, an upper flange (i.e., the flange which is that nearest the floor of the building in which the I-beam is used) and a lower flange (i.e., the flange sitting furthest away from (and below) the floor of the building in which the I-beam is used), with a web therebetween. The web is often, but not always, formed of plywood, oriented strandboard ("OSB") or other form of engineered lumber, and inserted into the flanges by means of a groove routed into the flanges. Engineered lumber refers to a lumber product made from natural wood, but that has been processed or engineered such that it is no longer in its original form. For instance, a laminate of strips of wood (from which the flanges of a wood I-beam are often formed), commonly referred to as laminated veneer lumber ("LVL"), would be considered engineered lumber. Likewise, OSB is another form of engineered lumber, formed by bonding wood particles with a resin system to form a relatively continuous sheet or web.

What is desirable, therefore, is a wood I-beam comprising two flanges with a generally continuous web arranged therebetween, where the I-beam has a time-to-failure and/or failure mode at least equivalent to solid sawn lumber.

SUMMARY OF INVENTION

It is an object of the present invention to provide an I-beam useful as a floor joist for residential or commercial construction.

It is another object of the present invention to provide an I-beam lighter in weight and less expensive to manufacture than a steel I-beam of corresponding dimensions.

It is still another object of the present invention to provide an I-beam stronger and lighter in weight than an equivalent length of solid sawn lumber joists.

It is a further object of the present invention to provide an I-beam having time-to-failure and failure mode at least equivalent to solid sawn lumber joists.

These objects and others that will become apparent to the artisan upon review of the following description can be accomplished by providing a composite I-beam having a first flange and a second flange, with a generally continuous web extending between the flanges. At least one of the flanges includes a reinforcing layer of a supporting material either thereon or therein. In particular, at least one of the flanges of the I-beam (and possibly both of the flanges) is a laminated flange having a plurality of wood members adhesively joined together into a generally rectangular cross-section, wherein a reinforcing layer of a supporting material is disposed between at least two of the plurality of wood members. The reinforcing layer is preferably a sheet of fibrous material having a thickness of no more than about 0.030 inch and can be a sheet of fiberglass, aramid fibers, para-aramid fibers, polymetaphenylene diamine fibers, polytetrafluoroethylene fibers, high modulus polyethylene, graphite fibers, carbon fibers, or mixtures thereof. The reinforcing layer of supporting material can also be disposed between more than two of the plurality of wood members in one or both of the laminated flanges or in the groove routed into one or both of the flanges.

In another embodiment of the claimed invention, at least one (and possibly both) of the flanges of the I-beam is made from a length of solid sawn lumber having a generally rectangular cross-section having two major and two minor surfaces, wherein a reinforcing layer of a supporting material is disposed on at least one of the major surfaces of the flange, and possible both of the major surfaces of the flange, or in the groove routed into the flanges. Again, the reinforcing layer can be a sheet or bundle of fibrous material having a thickness of no more than about 0.030 inch, formed from a sheet of fiberglass, aramid fibers, para-aramid fibers, polymetaphenylene diamine fibers, polytetrafluoroethylene fibers, high modulus polyethylene, graphite fibers, carbon fibers, or mixtures thereof.

BRIEF DESCRIPTION OF THE DRAWINGS

The present invention will be better understood and its advantages more apparent in view of the following detailed description, especially when read with reference to the appended drawings, wherein.

DETAILED DESCRIPTION OF THE PREFERRED EMBODIMENT

Figure 1:
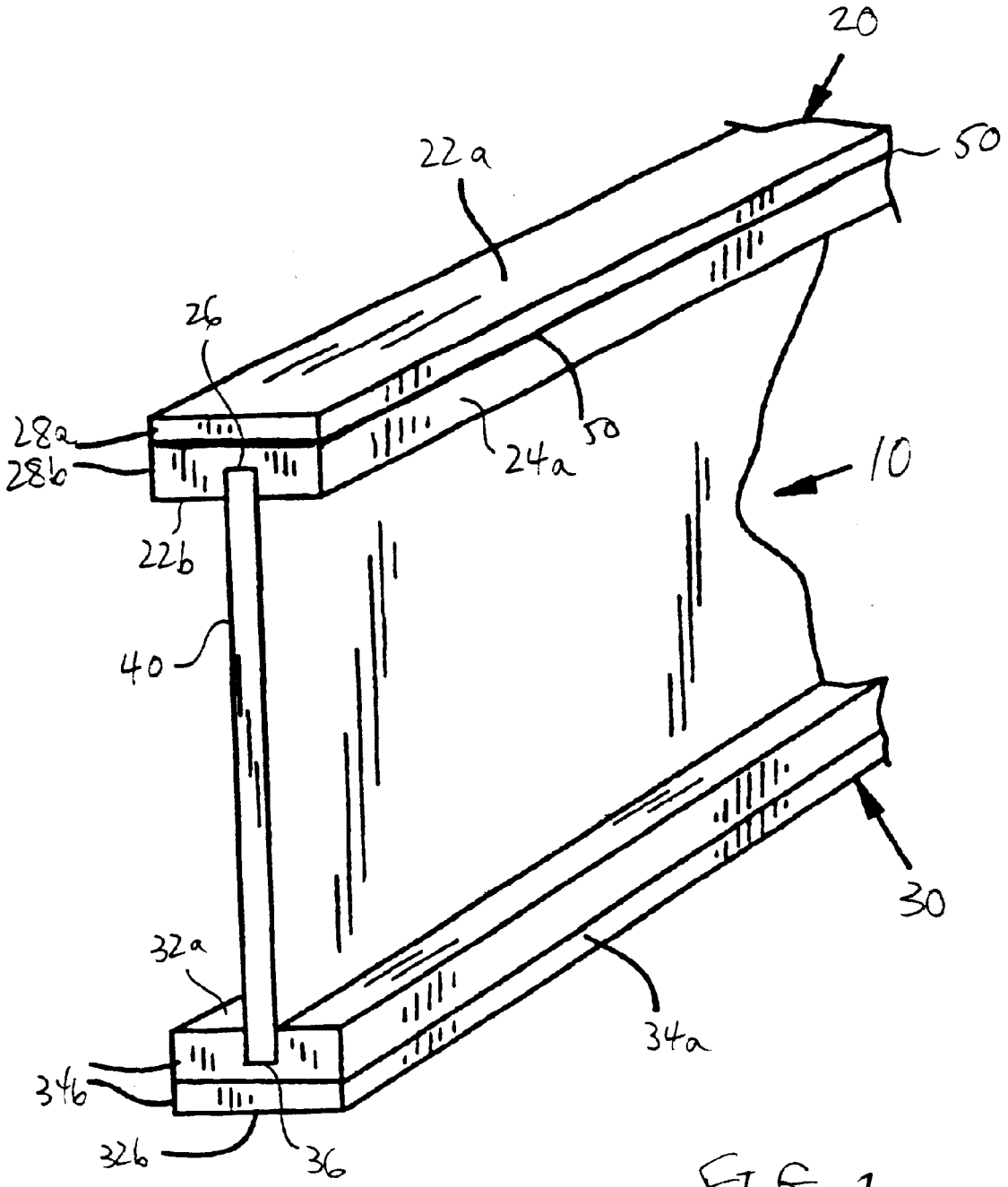
FIG. 1 is a side perspective view of a wood I-beam in accordance with the present invention.

Referring to the drawings in detail, a wood I-beam prepared in accordance with the present invention is shown and generally designated by the reference numeral 10. It should be noted that for the sake of clarity not all the components and elements of wood I-beam 10 may be shown and/or marked in all the drawings. Also, as used herein, the terms "top," "bottom," "upper," "lower," etc. refer to wood I-beam 10 when in the orientation shown in FIG. 1. However, the artisan will recognize that wood I-beam 10 can adopt any particular orientation when in use.

Wood I-beam 10 can be used as a floor joist in residential or commercial construction. Alternatively, wood I-beam 10 can be used in any other application in which a solid sawn lumber floor joist can be used, including as a ceiling or roofing joist, etc. Wood I-beam 10 has as its major components two flanges, and upper flange 20 an a lower flange 30 and a web 40 therebetween. Flanges 20 and 30 of wood I-beam 10 can be said to include an upper flange 20 and a lower flange 30. Flanges 20 and 30 can be formed of a length of solid sawn lumber, such as spruce, fir or pine, or other appropriate woods, or they can be formed of as a laminate of a plurality of wood members adhesively joined together into a generally rectangular cross-section (for the purposes of simplicity, flanges 20 and 30 are illustrated as each being a laminate of two wood members adhesively joined together; however, flanges 20 and 30 can be formed of solid sawn lumber, as noted above, or as a laminate of more than two, and up to about 20 or more wood members adhesively joined together).

Figure 3:
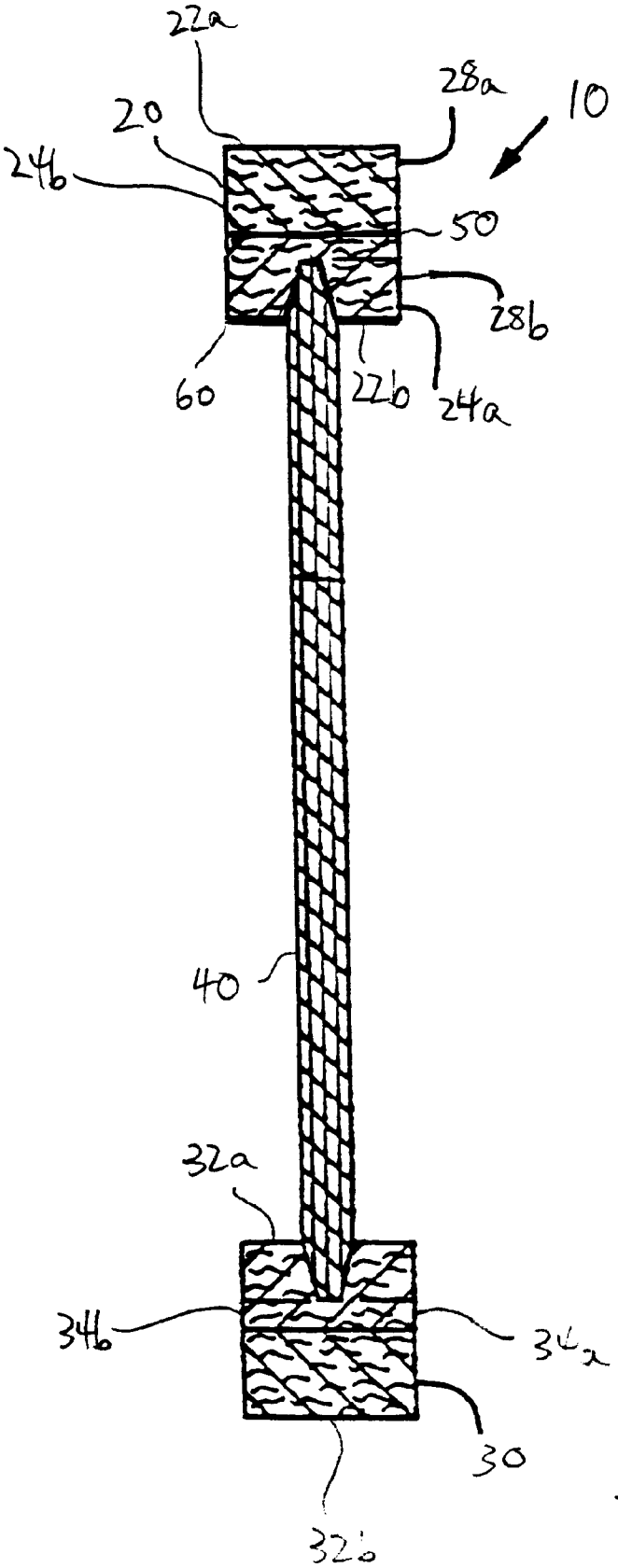
FIG. 3 is a side cross-sectional view of the wood I-beam of FIG. 2 in accordance with the present invention.

Each of flanges 20 and 30 have two major surfaces 22*a* and 22*b*, and 32*a* and 32*b*, respectively and two minor surfaces 24*a* and 24*b*, and 34*a* and 34*b*, respectively, as shown in FIGS. 1 and 3. In most cases major surfaces 22*a*, 22*b*, 32*a*, 32*b* of flanges 20 and 30 are longer than minor surfaces 24*a*, 24*b*, 34*a*, 34*b*; however, that is not necessarily the case. As used herein, the terms "major surfaces" and "minor surfaces" are used to distinguish the upper and lower surfaces of flanges 20 and 30 (major surfaces) and the side surfaces of flanges 20 and 30 (minor surfaces) when in the orientation of FIG. 1.

In most cases, upper flange 20 and lower flange 30 are similar in construction and materials, but this is not necessary. For instance, upper flange 20 can be made from a laminated flange comprising a plurality of wood members adhesively joined together into a generally rectangular cross-section, and lower flange 30 can be formed from a length of solid sawn lumber having a generally rectangular cross-section 32, and vice versa. Most commonly, however, upper flange 20 and lower flange 30 are each made from the same material, either each being a laminated flange comprising a plurality of wood members adhesively joined together into a generally rectangular cross-section 22 or each being a length of solid sawn lumber having a generally rectangular cross-section 32.

Figure 2:
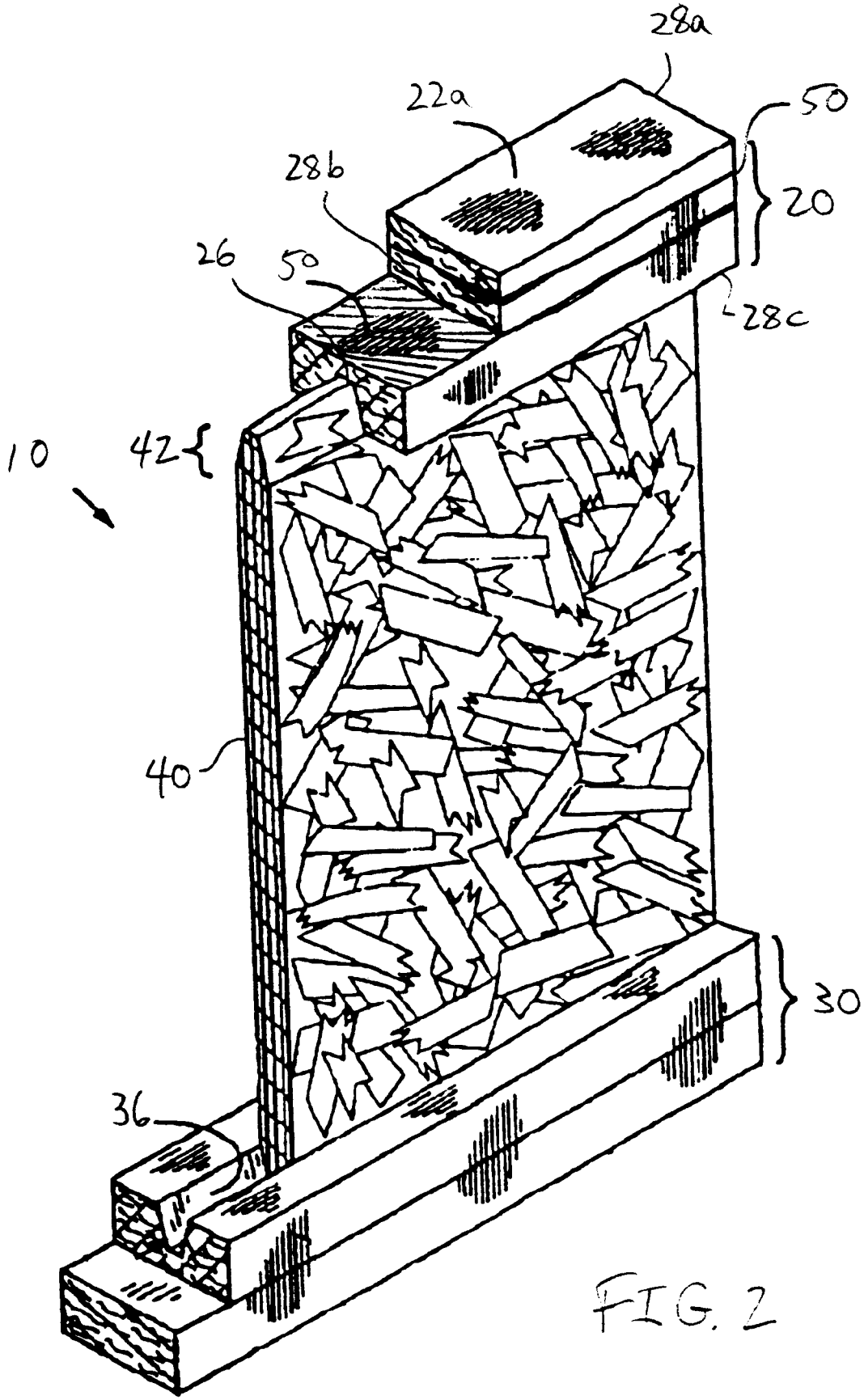
FIG. 2 is a partially broken-away side perspective view of an alternative embodiment of a wood I-beam in accordance with the present invention.

The length of flanges 20 and 30 will depend on the particular application; however, for most residential and commercial floor joist uses, flanges 20 and 30 will be from about 10 feet to about 50 feet in length. The other dimensions of flanges 20 and 30 will again depend on the particular application, and desired characteristics such as strength and flexibility; typically, flanges 20 and 30 are each about 2 inches to about 5 inches along their major surfaces 22*a*, 22*b*, 32*a*, 32*b* and about 0.5 inches to about 3 inches along their minor surfaces 24*a*, 24*b*, 34*a*, 34*b* (provided that major surfaces 22*a*, 22*b*, 32*a*, 32*b* are longer than minor surfaces 24*a*, 24*b*, 34*a*, 34*b*). Generally, a web receiving groove 26, 36 is formed in one of the major surfaces of each of flanges 20 and 30, as illustrated in FIGS. 1 and 2. More particularly, groove 26 is formed in the major surface of flange 20 (such as major surface 22*b*) that faces towards flange 30, and groove 36 is formed in the major surface of flange 30 (such as major surface 32*a*) that faces towards flange 20. In this way, web 40 can be received in grooves 26 and 36 and maintained in place between flanges 20 and 30 more stably.

When either or both flange 20 or flange 30 is formed as a laminate of a plurality of wood members adhesively joined together into a generally rectangular cross-section, a reinforcing layer of a supporting material 50 is disposed between two of the wood members 28*a*, 28*b* of at least one of flange 20 or 30 formed as a laminate. Most preferably, upper flange 20 is formed as a laminate and has reinforcing layer 50 disposed between two of the wood members 28*a*, 28*b*. Advantageously, reinforcing layer 50 is disposed between wood members located at or near the middle of flange 20 or 30 (as opposed to being located near the upper or lower major surface 22*a*, 22*b* of laminate 22), as illustrated in FIGS. 1–3. In this way, reinforcing layer 50 will be protected the longest in case of burning of flange 20 or 30. Although in most cases, the laminate comprises several wood members 28*a*, 28*b*, etc., each of which is relatively thin (on the order of no more than about 0.25 inches in thickness), wood members 28*a*, 28*b* can also comprise lengths of oriented strand board, as described in U.S. Pat. No. 6,012,262, the disclosure of which is incorporated herein by reference.

Reinforcing layer 50 is preferably a sheet of fibrous material having a thickness of no more than about 0.030 inch (and typically no less than about 0.003 inch) and can be a sheet of fiberglass; aramid fibers; para-aramid fibers, like poly-paraphenylene terephthalamide fibers commercially available from E.I. du Pont de Nemours and Company as KEVLAR® fibers; polymetaphenylene diamine fibers commercially available from E.I. du Pont de Nemours and Company as NOMEX® fibers; fluorocarbon fibers like polytetrafluoroethylene (PTFE) fibers commercially available from E.I. du Pont de Nemours and Company as TEFLON® fibers; high modulus polyethylene; graphite fibers; carbon fibers; or mixtures thereof. If desired, reinforcing layer 50 can be adhered in place using the same adhesive as is used to form laminate 22, or a different adhesive, like an epoxy or a phenolic adhesive. Advantageously, reinforcing layer 50 is disposed between more than two of the wood members 28*a*, 28*b*, 28*c* of the laminate, for increased support, as shown in FIG. 2. Most advantageously, each of flanges 20 and 30 are formed from the laminate and have reinforcing layer 50 disposed between at least two of its constituent wood members.

When either or both flange 20 or flange 30 is formed from a length of solid sawn lumber having a generally rectangular cross-section 32, a reinforcing layer of a supporting material 60 is disposed on at least one of the major surfaces 24*a*, 24*b*, 34*a*, 34*b* of at least one of flange 20 and flange 30. Preferably, reinforcing layer 60 is adhered in place using an adhesive that can be used to form a wood laminate, or a different adhesive, like an epoxy or phenolic adhesive. Advantageously, reinforcing layer is disposed on the major surface of flange 20 or 30 (and preferably both flange 20 and flange 30) in which groove 26 or 36 is formed. Reinforcing layer 60 is preferably a sheet of fibrous material having a thickness of no more than about 0.030 inch and can be a sheet of fiberglass; aramid fibers; para-aramid fibers; polymetaphenylene diamine fibers; fluorocarbon fibers; high modulus polyethylene; graphite fibers; carbon fibers; or mixtures thereof In other words, reinforcing layer 60 can be made in the same manner and from the same materials as reinforcing layer 50.

Web 40, disposed between flanges 20 and 30, can be formed of any appropriate generally continuous material, such as plywood. Preferably, however, web 40 is formed of oriented strand board (OSB), sometimes referred to as oriented strand lumber (OSL). Oriented strand board, as used herein and as generally understood by the artisan, refers to an engineered lumber product which incorporates oriented strands of wood fiber bonded with an adhesive and cured in a hot platen press. Web 40 should most preferably have a length approximately equal to the length of flanges 20 and 30 (i.e., from about 10 to about 50 feet), a height (i.e., the distance between flanges 20 and 30 when web 40 is disposed therebetween) of about 7 inches to about 30 inches, and a width of about 0.15 to about 1.5 inches. Correspondingly, grooves 26, 36 should be sized so as to receive web 40, or a tapered portion 42 of web 40, and thereby maintain it stably in place between flanges 20 and 30. A suitable adhesive can also be used to maintain web 40 in grooves 26, 36.

By incorporating reinforcing layer 50 in flange 20 or 30, or reinforcing layer 60 on flange 20 or 30, increased support is provided to the flange, and thus to I-beam 10. In this manner, the time-to-failure of I-beam 10 in case of fire can be improved, as compared to a similar wood I-beam without reinforcing layer 50 or reinforcing layer 60. Indeed, time-to-failure can approach or even exceed the solid sawn lumber joists currently being used in residential and/or commercial construction. Moreover, the mode of failure of I-beam 10 can also be improved, so as to more closely resemble solid sawn lumber joists, rather than the sudden and catastrophic failure often seen with wood I-beams not employing reinforcing layer 50 or reinforcing layer 60. Another potential advantage is that the strength of wood I-beam 10 per se, as opposed to under extraordinary conditions like a fire, can be improved so as to be superior to solid sawn lumber. In this way, wood I-beam 10 can be used to provide a stronger weight-bearing surface.

In order to provide even further flame retardancy to wood I-beam 10, wood I-beam 10 (or at least one of flanges 20, 30 or web 40) can also be coated or otherwise treated with an intumescent composition, especially one that contains particles of expandable graphite. By "treated with" is meant that wood I-beam 10 is formed using the intumescent composition during formation, such as in the resin system used in OSB web 40. Expandable graphite is graphite that has been intercalated with intercalants such as sulfuric and nitric acids under conditions to render the graphite expandable when exposed to high temperatures, such as a flame. Expansion of the graphite can delay or prevent spread of the flame to the substrate on which the composition is coated or with which the composition is treated (i.e., wood I-beam 10). Suitable intumescent compositions containing particles of expandable graphite are described in, for instance, International Publication No. WO 99/35196 and U.S. Pat. No. 5,968,669, the disclosures of each of which are incorporated herein by reference.

More particularly, a common method for manufacturing expandable graphite is described by Shane et al. in U.S. Pat. No. 3,404,061, the disclosure of which is incorporated herein by reference. In the typical practice of the Shane et al. method, graphite flakes are intercalated by dispersing the flakes in a solution containing e.g., a mixture of nitric and sulfuric acid. The intercalation solution contains oxidizing and other intercalating agents known in the art. Examples include those containing oxidizing agents and oxidizing mixtures, such as solutions containing nitric acid, potassium chlorate, chromic acid, potassium permanganate, potassium chromate, potassium dichromate, perchloric acid, and the like, or mixtures, such as for example, concentrated nitric acid and chlorate, chromic acid and phosphoric acid, sulfuric acid and nitric acid, or mixtures of a strong organic acid, e.g. trifluoroacetic acid, and a strong oxidizing agent soluble in the organic acid. Alternatively, an electric potential can be used to bring about oxidation of the graphite. Chemical species that can be introduced into the graphite crystal using electrolytic oxidation include sulfuric acid as well as other acids.

In a preferred embodiment, the intercalating agent is a solution of a mixture of sulfuric acid, or sulfuric acid and phosphoric acid, and an oxidizing agent such as nitric acid, perchloric acid, chromic acid, potassium permanganate, hydrogen peroxide, iodic or periodic acids, or the like. Although less preferred, the intercalation solution may contain metal halides such as ferric chloride, and ferric chloride mixed with sulfuric acid, or a halide, such as bromine as a solution of bromine and sulfuric acid or bromine in an organic solvent.

After the flakes are intercalated, any excess solution is drained from the flakes and the flakes are water-washed. The quantity of intercalation solution retained on the flakes after draining may range from about 50 to 150 parts of solution by weight per 100 parts by weight of graphite flakes (pph) and more typically about 50 to 120 pph. Alternatively, the quantity of the intercalation solution may be limited to between 10 to 50 parts of solution per hundred parts of graphite by weight (pph) which permits the washing step to be eliminated as taught and described in U.S. Pat. No. 4,895,713, the disclosure of which is also herein incorporated by reference.

Upon exposure to high temperature, e.g. a fire, the particles of intercalated graphite expand as much as 80 to 1000 or more times their original volume in an accordion-like fashion in the c-direction (in the direction perpendicular to the crystalline planes of the constituent graphite particles) to form expanded graphite particles or worms, which can function to retard flame spread.

The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A composite I-beam comprising a first and a second flange and a web extending therebetween, the first and the second flanges each having a first major surface facing the web, at least one of the major surfaces defining a groove formed therein, wherein a reinforcing layer of a supporting material is disposed in the groove.

2. The I-beam of claim 1 wherein at least one of the flanges comprises a laminated flange comprising a plurality of wood members adhesively joined together into a generally rectangular cross-section, wherein a reinforcing layer of a supporting material is disposed between at least two of the plurality of wood members.

3. The I-beam of claim 2 wherein the reinforcing layer comprises a sheet of fibrous material having a thickness of no more than about 0.030 inch.

4. The I-beam of claim 3 wherein the sheet of fibrous material comprises a sheet of fiberglass, aramid fibers, para-aramid fibers, polymetaphenylene diamine fibers, fluorocarbon fibers, high modulus polyethylene fibers, graphite fibers, carbon fibers, or mixture thereof.

5. The I-beam of claim 2 wherein a reinforcing layer of a supporting material is disposed between more than two of the plurality of wood members.

6. The I-beam of claim 2 wherein the first and second flanges each comprise a laminated flange comprising a plurality of wood members adhesively joined together into a generally rectangular cross-section, wherein a reinforcing layer of a supporting material is disposed between at least two of the plurality of wood members of each of the flanges.

* * * * *

UNITED STATES PATENT AND TRADEMARK OFFICE

CERTIFICATE OF CORRECTION

PATENT NO. : 6,460,310 B1
DATED : October 8, 2002
INVENTOR(S) : Ford et al.

It is certified that error appears in the above-identified patent and that said Letters Patent is hereby corrected as shown below:

Column 3,
Line 18, "...flange 20 an a lower flange 30" should read as -- ...flange 20 and a lower flange 30 --

Column 5,
Line 4, "mixtures thereof In other words,…" should read as -- mixtures thereof. In other words,…--

Signed and Sealed this

Fourth Day of March, 2003

JAMES E. ROGAN
*Director of the United States Patent and Trademark Office*